US011056816B2

(12) United States Patent
Hung

(10) Patent No.: US 11,056,816 B2
(45) Date of Patent: Jul. 6, 2021

(54) ELECTRICAL TERMINAL AND ELECTRICAL CONNECTOR THEREOF

(71) Applicant: Dongguan Luxshare Technologies Co., Ltd, Dongguan (CN)

(72) Inventor: Yung-Chih Hung, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 0 days.

(21) Appl. No.: 16/864,770

(22) Filed: May 1, 2020

(65) Prior Publication Data

US 2020/0259285 A1 Aug. 13, 2020

(30) Foreign Application Priority Data

Nov. 4, 2019 (TW) ..... 108139984

(51) Int. Cl.

| | |
|---|---|
| ***H01R 13/42*** | (2006.01) |
| ***H01R 13/46*** | (2006.01) |
| ***H01R 13/10*** | (2006.01) |
| ***H01R 13/11*** | (2006.01) |
| *H01R 4/18* | (2006.01) |

(52) U.S. Cl.

CPC ..... *H01R 13/42* (2013.01); *H01R 13/10* (2013.01); *H01R 13/113* (2013.01); *H01R 13/46* (2013.01); *H01R 4/185* (2013.01)

(58) Field of Classification Search

CPC ..... H01R 33/945; H01R 13/42; H01R 13/10; H01R 13/113; H01R 13/46; H01R 4/185

See application file for complete search history.

(56) References Cited

U.S. PATENT DOCUMENTS 3,697,925 A * 10/1972 Henschen ..... H01R 12/69 439/494
3,711,819 A * 1/1973 Matthews ..... H01R 13/11 439/682
6,663,422 B1 * 12/2003 Robinson ..... H01R 33/945 361/666

(Continued)

FOREIGN PATENT DOCUMENTS

CN 1574483 A 2/2005
CN 1682414 B 5/2010

(Continued)

*Primary Examiner* — Abdullah A Riyami
*Assistant Examiner* — Nader J Alhawamdeh
(74) *Attorney, Agent, or Firm* — Birch, Stewart, Kolasch & Birch, LLP

(57) ABSTRACT

An electrical terminal includes a terminal body and a mounting portion. The terminal body includes a front end, a rear end, and two lateral edges opposite to each other. The front end and the rear end are arranged opposite to each other, and the two lateral edges are connected to the front end and the rear end. The terminal body further includes one or more bending wings formed on one of the two lateral edges. The bending wing is provided with a notch, one side of the notch corresponding to the front end is closed. The mounting portion is extended from the rear end, and the mounting portion is provided with a fixing member. An electrical connector is also disclosed, which includes the electrical terminal provided with the notch to achieve the fixing operation of the electrical terminal.

9 Claims, 13 Drawing Sheets

(56) References Cited

U.S. PATENT DOCUMENTS

| | | | | |
|---|---|---|---|---|
| 7,744,408 | B2 | 6/2010 | Komatsu | |
| 8,323,049 | B2 | 12/2012 | Ngo | |
| 9,059,546 | B2 * | 6/2015 | Yu | H01R 31/085 |
| 9,130,287 | B2 * | 9/2015 | Tai | H01R 13/112 |
| 9,362,675 | B2 * | 6/2016 | Yu | H01R 12/724 |
| 9,515,406 | B2 * | 12/2016 | Yu | H01R 13/41 |
| 9,537,227 | B1 * | 1/2017 | Morello | H01R 43/16 |
| 10,468,800 | B2 * | 11/2019 | Huang | H01R 12/7005 |
| 2013/0078863 | A1 * | 3/2013 | Chiang | H01R 13/113 439/660 |
| 2015/0200485 | A1 * | 7/2015 | Yu | H01R 13/521 439/521 |
| 2016/0226176 | A1 * | 8/2016 | Yu | H01R 4/02 |
| 2020/0259278 | A1 * | 8/2020 | Hung | H01R 13/502 |
| 2020/0259280 | A1 * | 8/2020 | Hung | H01R 12/7005 |
| 2020/0259285 | A1 * | 8/2020 | Hung | H01R 13/113 |
| 2020/0280142 | A1 * | 9/2020 | Hung | H01R 9/24 |
| 2020/0335888 | A1 * | 10/2020 | Hung | H01R 13/6271 |
| 2020/0335889 | A1 * | 10/2020 | Hung | H05K 3/308 |

FOREIGN PATENT DOCUMENTS

| | | | |
|---|---|---|---|
| CN | 203747183 | U | 7/2014 |
| CN | 102301537 | B | 8/2014 |
| CN | 206283014 | U | 6/2017 |
| CN | 206283046 | U | 6/2017 |
| CN | 206806561 | U | 12/2017 |
| CN | 206908021 | U | 1/2018 |
| CN | 207265268 | U | 4/2018 |
| CN | 108346869 | A | 7/2018 |
| TW | 201244269 | A1 | 11/2012 |

* cited by examiner

ELECTRICAL TERMINAL AND ELECTRICAL CONNECTOR THEREOF

CROSS-REFERENCE TO RELATED APPLICATION

This non-provisional application claims priority under 35 U.S.C. § 119(a) to patent application Ser. No. 10/813,9984 in Taiwan, R.O.C. on Nov. 4, 2019, the entire contents of which are hereby incorporated by reference.

BACKGROUND

Technical Field

This disclosure relates to an electrical terminal and an electrical connector, and in particular, to an electrical terminal and an electrical connector including the electrical terminal.

Related Art

An electrical connector, for example a connector on a circuit board for power or signal transmissions, usually includes an electrical-insulated base and plural electrical terminals. The electrical terminals are used to contact external terminals. Depending on different types of external terminals, the electrical terminals are provided with different types as well.

The electrical terminal used for power transmission is usually configured in a plate-shape, to increase the contact area between the electrical terminal of the electrical connector and the external terminal, so as to be adopted for large-current transmission. That is, besides the external terminals configured as plate-shape structures and aligned densely in parallel, the terminal bodies of the electrical terminals of the electrical connector are also configured as plate-shapes and aligned densely. The terminal bodies of these electrical terminals are usually provided with fixing holes for the fixing posts of the base to pass through so as to fix the electrical terminals in the base.

However, the space in the base is limited, and it is not easy to install and fix the plate-shape electrical terminals in a small space, thereby slowing down the assembly process of the electrical connector. Moreover, a space between adjacent electrical terminals is needed to be reserved for installation work, which is unfavorable in shortening the distance between adjacent electrical terminals.

SUMMARY

In order to solve the fixation problem of the electrical terminal in the electrical connector, one or some embodiments of this disclosure propose an electrical terminal and an electrical connector, in which the electrical terminal can be effectively fixed and can be installed easily.

An electrical terminal according to one or more embodiments of this disclosure includes a terminal body and a mounting portion. The terminal body includes a front end, a rear end, and two lateral edges opposite to each other. The front end and the rear end are opposite to each other, and the two lateral edges are connected to the front end and the rear end. The terminal body further includes at least one bending wing formed on one of the two lateral edges, and the at least one bending wing is provided with a notch, one side of the notch corresponding to the front end is closed. The mounting portion is extended from the rear end, and the mounting portion is provided with a fixing member.

In at least one embodiment, the terminal body includes two of the bending wings respectively formed on the two lateral edges, and at least one of the two bending wings is provided with the notch.

In at least one embodiment, each of the two bending wings is provided with the notch, and projections of the two notches of the two bending wings overlap with each other.

In at least one embodiment, the notch is an opening defined through the bending wing.

In at least one embodiment, the notch is partially extended to the terminal body.

In at least one embodiment, the electrical terminal further includes at least one contact portion extended from the front end.

In at least one embodiment, the contact portion includes at least one first clamping piece and at least one second clamping piece opposite to each other, wherein a front tip of the at least one first clamping piece and a front tip of the at least one second clamping piece respectively forms a guiding bevel inclined outwardly.

An electrical connector according to one or more embodiments of this disclosure includes the aforementioned electrical terminal and a base. The base includes a front surface, a rear surface, a top surface, and a bottom surface. The front surface and the rear surface are opposite to each other. The top surface and the bottom surface are opposite to each other and connected to the front surface and the rear surface. At least one installation trough is formed on the rear surface, for receiving the mounting portion of the electrical terminal. The at least one installation trough communicates with the front surface through at least one insertion hole. The at least one insertion hole includes a fixing section and an open section, the fixing section is connected to the at least one installation trough and the open section communicates with the rear surface.

The fixing section includes a first wall surface and a second wall surface opposite to each other, and the first wall surface is provided with at least one guiding groove for being embedded with an edge of the at least one bending wing, so that the terminal body abuts against the second wall surface.

In at least one embodiment, the electrical terminal further includes at least one contact portion extended from the front end and is inserted into the open section.

In at least one embodiment, the first wall surface and the second wall surface are arranged in parallel to an altitude direction directed from the bottom surface to the top surface.

In at least one embodiment, the at least one installation trough communicates with the front surface through two of the insertion holes, the second wall surfaces of the two insertion holes are away from each other, and two of the electrical terminals are received in the at least one installation trough.

In at least one embodiment, the two insertion holes in the altitude direction are arranged in misalignment, and the two insertion holes are located at different heights in the altitude direction.

In at least one embodiment, the base further includes a pin hole formed on the top surface or the bottom surface of the base and communicates with the fixing section, and a position of the pin hole communicating with the fixing section corresponds to a position of the notch.

In at least one embodiment, the electrical connector further includes at least one fixing pin for being inserted into the pin hole to pass through the notch.

In at least one embodiment, the base further includes a plurality of the insertion holes and a plurality of the pin holes. Each of the pin holes is on the top surface or the bottom surface, and communicates with the fixing section of one of the insertion holes. The insertion holes are arranged alternately on the top surface and the bottom surface.

In at least one embodiment, the fixing section has a stepped segment with respect to the open section.

In one or more embodiments of this disclosure, the bending wing formed on the edges of the electrical terminal assists the position orientation of the electrical terminal when the electrical terminal is installed into the base of the electrical connector. The bending wing is further provided with the notch, so that the fixing pin can be inserted into the notch of the bending wing. Because the notch is located at the bending wing, the pin hole for being inserted by the fixing pin is on the top surface or the bottom surface of the base. Therefore, unnecessary holes are not formed on the front surface so as to prevent the wrong insertion of external terminals.

BRIEF DESCRIPTION OF THE DRAWINGS

This disclosure will become more fully understood from the detailed description given herein below for illustration only and thus not limitative of this disclosure, wherein.

DETAILED DESCRIPTION

Please refer to FIG. 1, FIG. 2, FIG. 3 and FIG. 4, an electrical terminal 100 according to a first embodiment of this disclosure is illustrated. The electrical terminal 100 is adapted to be installed into a base 200 to form an electrical connector 1.

Figure 1:
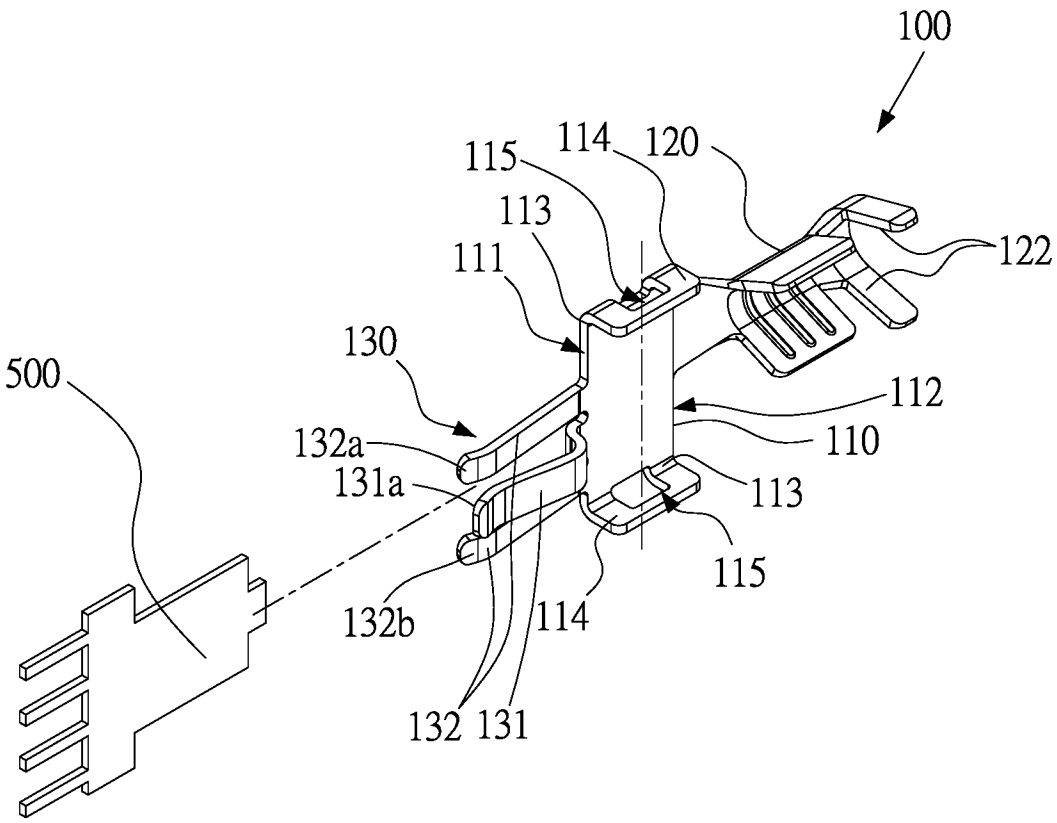
FIG. 1 illustrates a perspective view of an electrical terminal according to a first embodiment of this disclosure.

As shown in FIG. 1, the electrical terminal includes a terminal body 110, a mounting portion 120, and at least one contact portion 130.

As shown in FIG. 1, the terminal body 110 has a front end 111, a rear end 112, and two lateral edges 113. The two lateral edges 113 are opposite to each other. The front end 111 and the rear end 112 are opposite to each other, and the two lateral edges 113 are connected to the front end 111 and the rear end 112. The terminal body 110 further includes two bending wings 114 respectively formed on the opposite two lateral edges 113, and the two bending wings 114 are located at the same side of the terminal body 110. The terminal body 110 is configured in a plate-shape, and the two bending wings 114 are substantially perpendicular to the terminal body 110.

As shown in FIG. 1, each of the bending wings 114 is provided with a notch 115. In the first embodiment, the notch 115 is an opening, and the opening is defined through the bending wing 114 and the notch 115 is partially extended to the terminal body 110. Moreover, projections of the two notches 115 of the two bending wings 114 overlap with each other.

Figure 4:
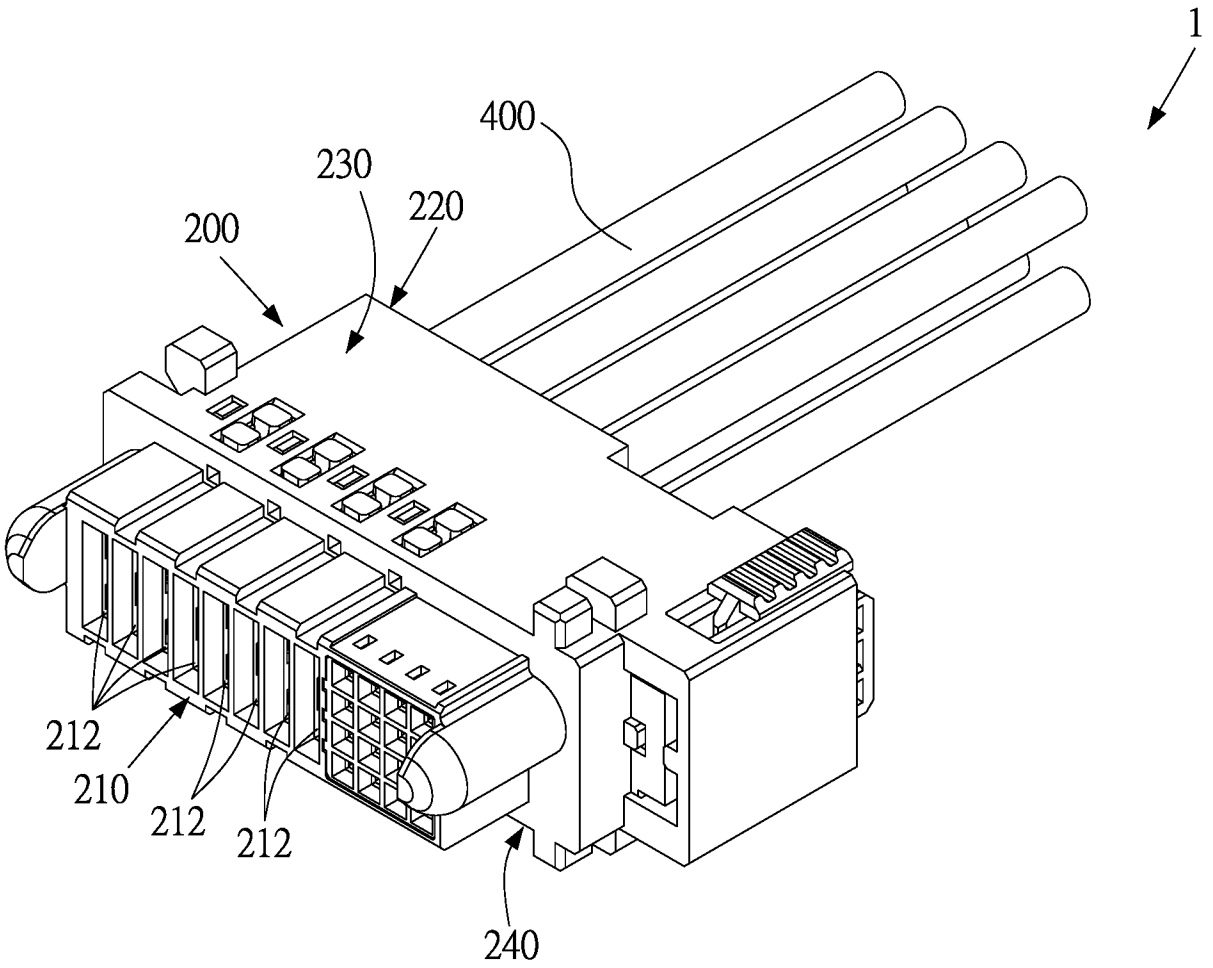
FIG. 4 illustrates a perspective view of the electrical connector of the first embodiment.

As shown in FIG. 1 and FIG. 4, the mounting portion 120 is extended from the rear end 112 and is used for connecting to a wire 400. The mounting portion 120 is provided with a fixing member 122, such as a clamping piece that can be bent, for fixing the mounting portion 220 on the wire 400, thereby strengthening the connection between the mounting portion 220 and the wire 400.

As shown in FIG. 1, the contact portion 130 is extended from the front end 111, and is adapted to contact the external terminal 500 inserted into the electrical connector 1 from outside. Therefore, the electrical connection between the external terminal 50 and the electrical terminal 100 can be achieved. The contact portion 130 may be a plate-shaped member, or even a portion of the terminal body 110. The configuration of the contact portion 130 may also be adapted to correspond to the configuration of the external terminal 500. Taking the first embodiment as an illustration, the external terminal 500 is an electrode plate, and the contact portion 130 is a clamping member having at least one first clamping piece 131 and at least one second clamping piece 132 opposite to each other. A front tip of the first clamping piece 131 and a front tip of the second clamping piece 132 respectively include a guiding bevel 131*a*, 132*a* inclined outwardly. The guiding bevels 131*a*, 132*a* are adapted to guide the external terminal 500 to be inserted into a space between the at least one first clamping piece 131 and the at least one second clamping piece 132, so that the external terminal 500 is clamped by the at least one first clamping piece 131 and the at least one second clamping piece 132. The number of the first clamping piece 131 and the number of the second clamping piece 132 depend upon the width of the external terminal 500. For example, in the first embodiment, the contact portion 130 has one first clamping piece 131 and two second clamping pieces 132, and the second clamping pieces 132 and the first clamping piece 131 are alternately arranged on the contact portion 130. Hence, the contact portion 130 can apply the force to the external terminal 500 through the first clamping piece 131 and the second clamping pieces 132 uniformly, and the contact area between the electrical terminal 100 and the external terminal 500 increases.

As shown in FIG. 1, FIG. 2, FIG. 3 and FIG. 4, the base 200 includes a front surface 210, a rear surface 220, a top surface 230, and a bottom surface 240. The front surface 210 and the rear surface 220 are opposite to each other. The top surface 230 and the bottom surface 240 are opposite to each other and connected to the front surface 210 and the rear surface 220. The rear surface 220 includes plural installation troughs 222, wherein each of the installation troughs 222 is adapted to receive one or more of the electrical terminals 100. Each of the installation troughs 222 communicates with the front surface 210 through one or more insertion holes 212. The terminal body 110 is inserted into the insertion hole 212 and the mounting portion 120 is received in the installation trough 222. In the first embodiment, each of the installation troughs 222 receives two electrical terminals 100. Therefore, each of the installation troughs 222 communicates with the front surface 210 through two insertion holes 212. Hence, the terminal bodies 110 of the two electrical terminals 100 are inserted into the two insertion holes 212, respectively. The two external terminals 500 are inserted from the front surface 210 from the insertion holes 212 and respectively contact the contact portion 130 of one of the electrical terminals 100.

Figure 5:
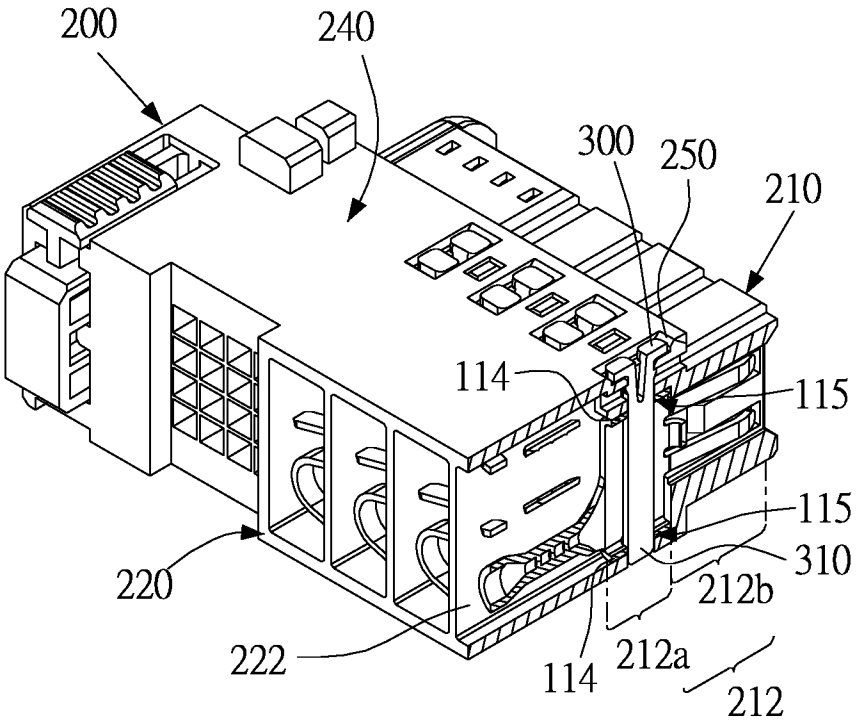
FIG. 5 illustrates a partial perspective sectional view of the electrical connector of the first embodiment.
Figure 6:
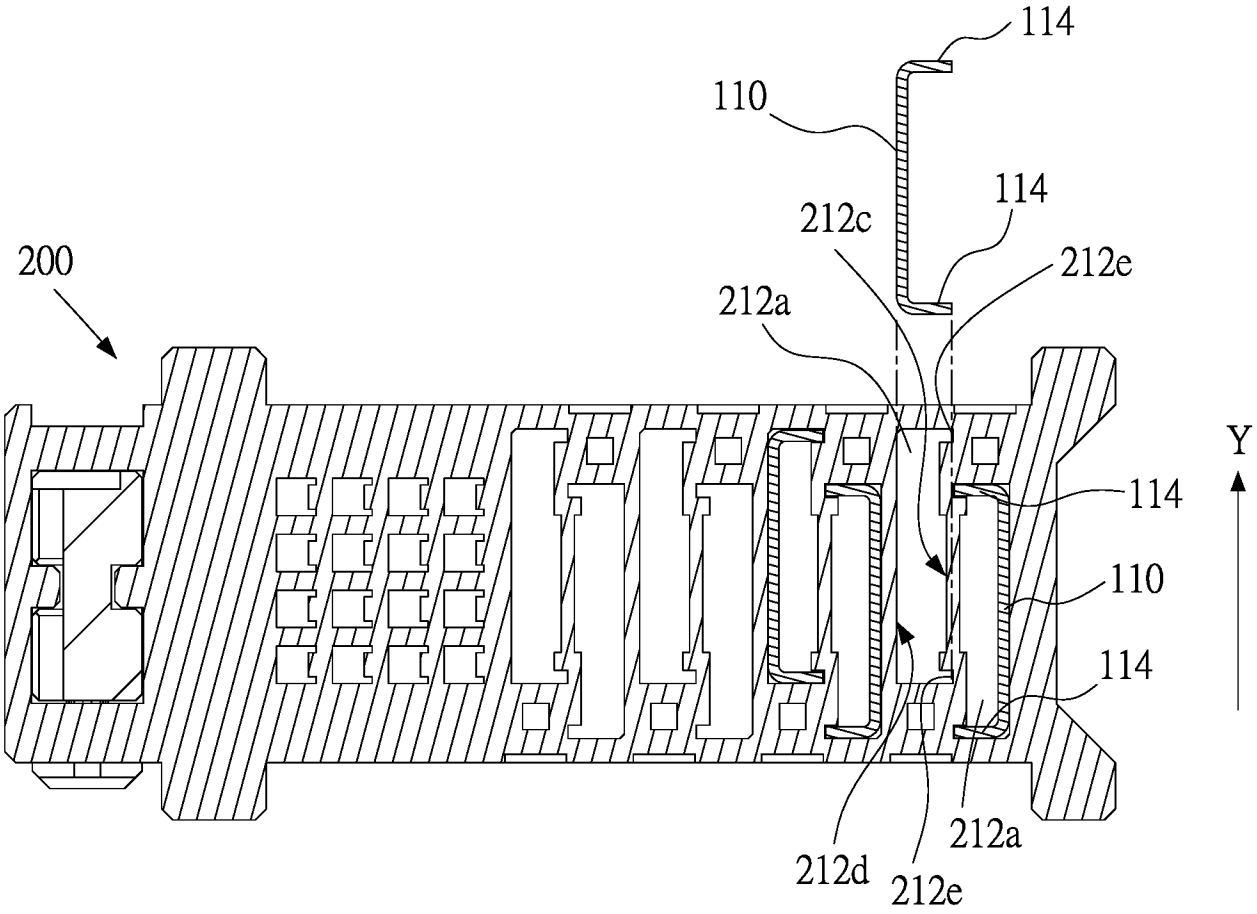
FIG. 6 illustrates a partial cross-sectional view of the electrical connector of the first embodiment.
Figure 7:
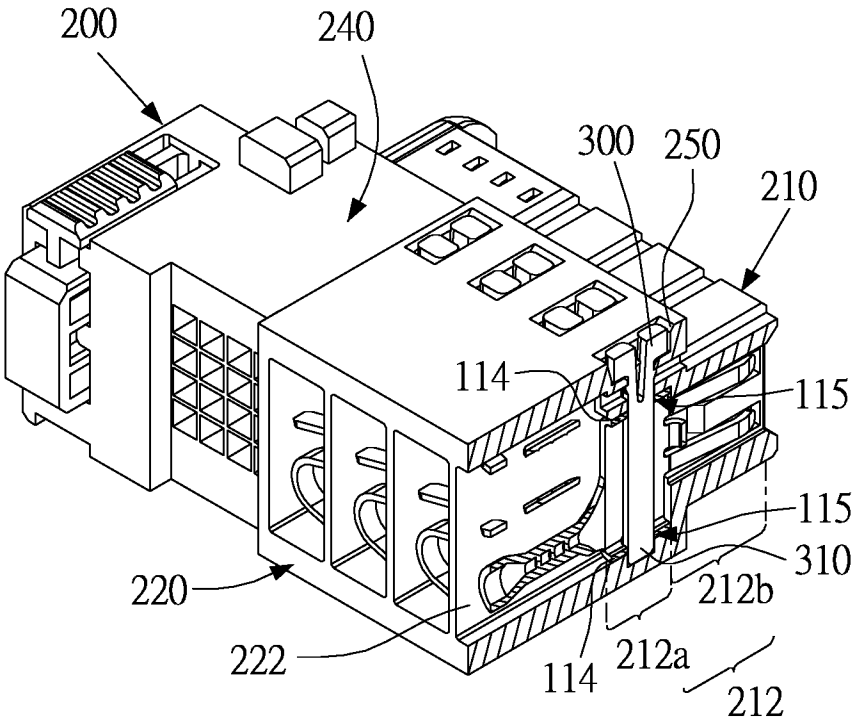
FIG. 7 illustrates a partial perspective sectional view of the electrical connector of the first embodiment.

As shown in FIG. 5, FIG. 6, and FIG. 7, each of the insertion holes 212 includes a fixing section 212*a* and an open section 212*b*. The fixing section 212*a* is connected to the at least one installation trough 222, and the open section 212*b* communicates with the front surface 210. The fixing section 212*a* includes a first wall surface 212*c* and a second wall surface 212*d* opposite to each other. The first wall surface 212*c* is provided with two guiding grooves 212*e*. The two guiding grooves 212*e* are provided for being embedded with the edge of the at least one bending wing 114, so that the at least one terminal body 110 abuts against the second wall surface 212*d* of the insertion hole 212. Therefore, the terminal body 110 can be fixed, and the orientation for inserting the terminal body 110 into the insertion hole 212 can be limited to make the contact portion 130 located into the open section 212*b*. Hence, the mating between the guiding groove 212*e* and the bending wing 114 provide a foolproof fixation function for the terminal body 21 when the electrical terminal 100 is installed to the base 200. Moreover, in one embodiment, the fixing section 212*a* has a stepped segment with respect to the open section 212*b* and so as to block the front end 111 of the terminal body 110. Therefore, under this configuration, the terminal body 110 cannot enter into the open section 212*b* and detach from the front surface 210 of the base 200.

As shown in FIG. 5 and FIG. 6, furthermore, an altitude direction Y is defined as a direction from the bottom surface 240 to the top surface 230. In each of the insertion holes 212, the first wall surface 212*c* and the second wall surface 212*d* of the fixing section 212*a* are arranged in parallel to the altitude direction Y. In each of the installation troughs 222, the second wall surface 212*d* of the two insertion holes 212 are spaced away from each other and the first wall surface 212*c* of the two insertion holes 212 are adjacent to each other. Moreover, in this embodiment, the two insertion holes 212 are arranged in misalignment in the altitude direction Y and located at different heights in the altitude direction Y. Therefore, when the electrical terminals 100 are installed in the installation troughs 222, the terminal bodies 110 are arranged in parallel in the altitude direction Y, and the bending wing 114 at one of the electrical terminal 100 is extended toward the terminal body 110 of the other electrical terminal 100. Moreover, the bending wings 114 of the two electrical terminals 100 are alternately arranged in the altitude direction Y, so that the bending wings 114 of the two electrical terminals 100 and the mounting portions 120 of the two electrical terminals 100 are not interfered with each other after the distance between the two electrical terminals 100 are reduced.

Figure 2:
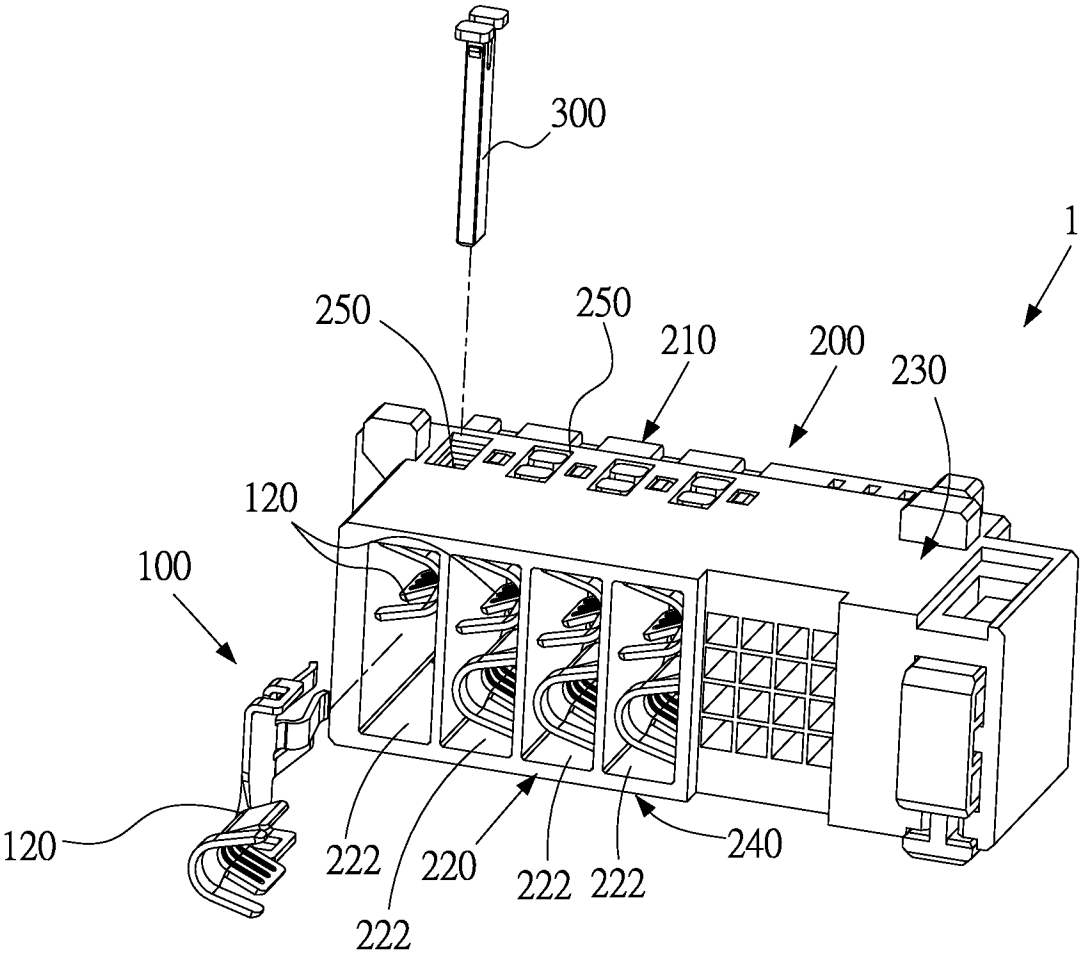
FIG. 2 illustrates an exploded view of an electrical connector of the first embodiment.
Figure 3:
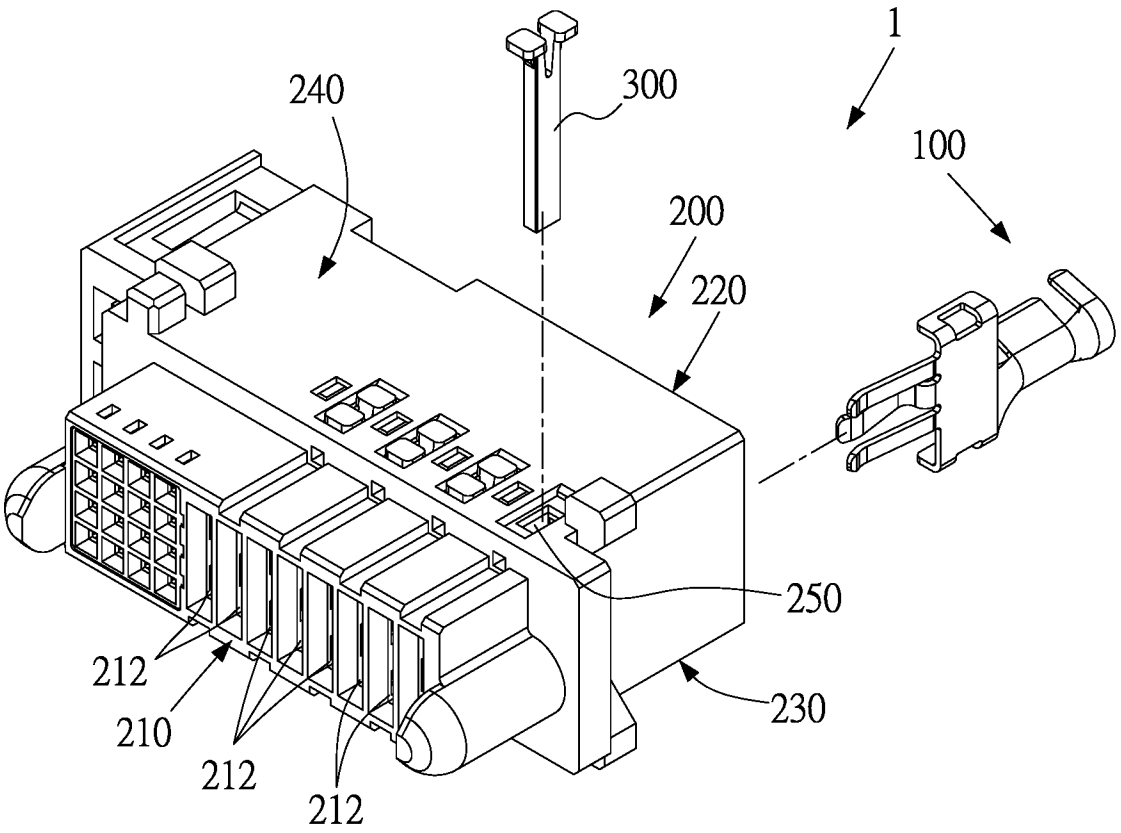
FIG. 3 illustrates another exploded view of the electrical connector of the first embodiment.

As shown in FIG. 2, the mounting portions 120 of the two electrical terminals 100 are arranged in misalignment in the altitude direction Y, so that the mounting portions 120 in the same installation trough 222 would be not interfered with each other due to the proximity of the terminal bodies 110.

As shown in FIG. 2, FIG. 3, FIG. 4, and FIG. 7, the base 200 further includes plural pin holes 250. The pin holes 250 are on the top surface 230 or the bottom surface 240 of the base 200 and communicate with one of the fixing section 212*a*. The pin holes 250 are arranged alternately on the top surface 230 and the bottom surface 240, that is, the pin holes 250 arranged on the top surface 230 and the pin holes 250 arranged on the bottom surface 240 are arranged adjacently, so that the pin holes 250 are alternately arranged with each other and communicate with the corresponding fixed sections 212*a*. A position of each of the pin holes 250 communicating with the corresponding fixing section 212*a* corresponds to a position of the notch 115. The electrical connector 1 further includes at least one fixing pin 300 for being inserted into the pin hole 250 to pass through the notch 115. The bending wing 114 is fixed by the fixing pin 300, thereby fixing the electrical terminal 100 in the base 200.

As shown in FIG. 5 and FIG. 7, the pin hole 250 is not necessarily defined through the base 200 from the top surface 230 to the bottom surface 240. In FIG. 5, the pin holes 250 are on the top surface 230 or the bottom surface 240 of the base 200 and intersected with and in communication with the corresponding fixing sections 212*a*, so as to extend toward the bottom surface 240 or the top surface 130. When the base 200 has a thinner thickness, the pin hole 250 may be further defined through the base 200 from the top surface 230 to the bottom surface 240, so that the portion of the lower end 310 of the fixing pin 300 held into the base 200 is longer. As shown in FIG. 7, when the base 200 has a thicker thickness, the pin hole 250 is not required to be defined to communicate the bottom surface 240 (the top surface 230), and the lower end 310 of the fixing pin 300 held into the base 200 is still long enough.

Figure 8:
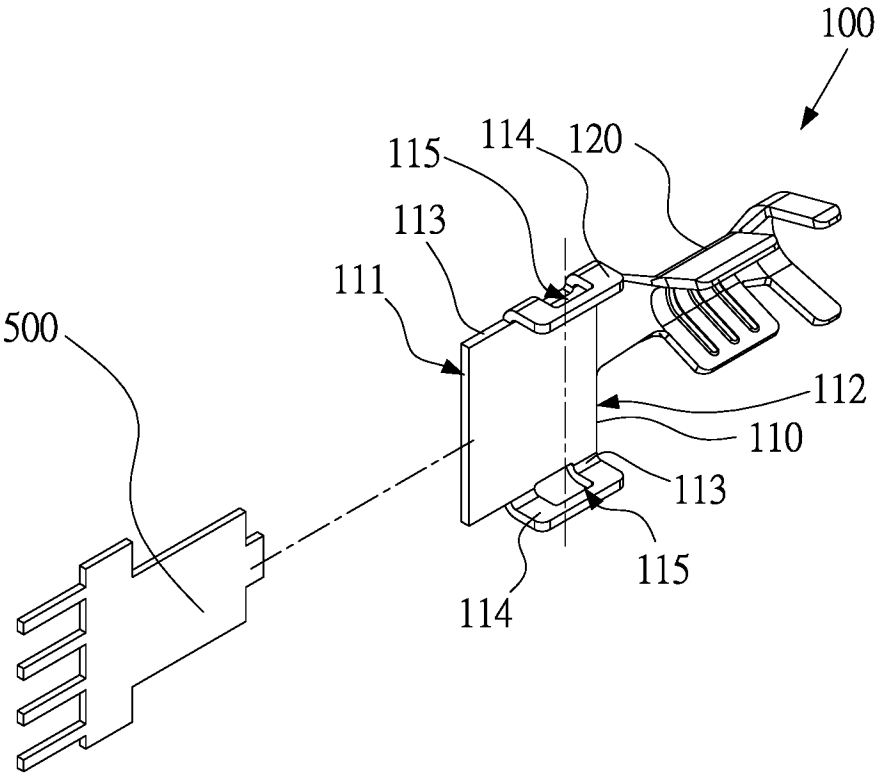
FIG. 8 illustrates a perspective view of one variation implementation of the electrical connector of the first embodiment.

As shown in FIG. 8, in the first embodiment or in other embodiments, the contact portion 130 may be omitted, and the length of the terminal body 110 may be increased; that is, the lengths of the lateral edges 113 are increased. Moreover, in this embodiment, the two bending wings 114 partially extend along the two lateral edges 113, respectively and are disposed adjacent to the rear end 112. Therefore, the external terminals 500 can directly contact the terminal body 110 to achieve the electrical connection, instead of contacting the terminal body 110 through the contact portion 130 shown in FIG. 1. It is understood that, increasing the length of the terminal body 110 is mainly adapted to increase the contact area between the external terminals 500 and the terminal body 110, as long as the length of the terminal body 110 is configured to match the length of the external terminal 500.

Figure 9:
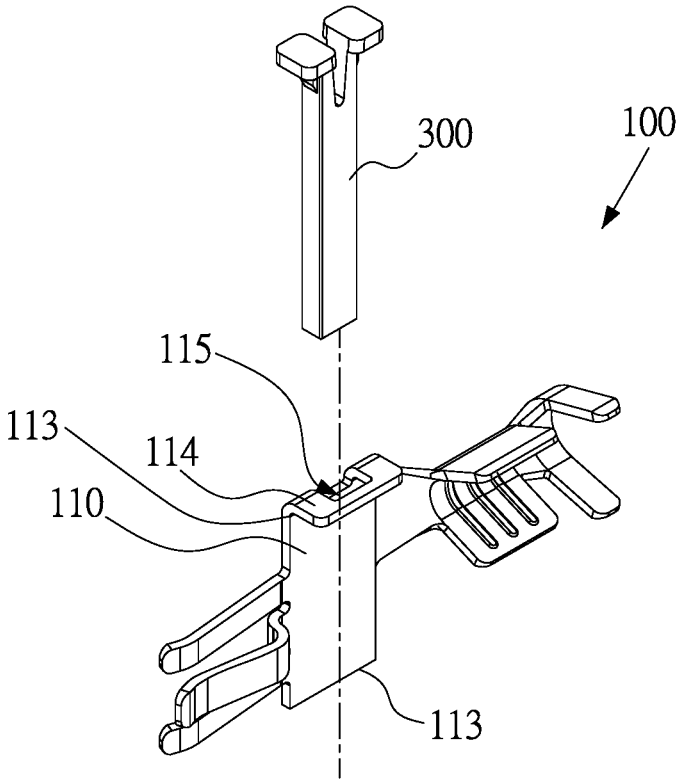
FIG. 9 illustrates a perspective view of an electrical terminal and fixing pin of an electrical connector according to a second embodiment of this disclosure.

As shown in FIG. 9, an electrical terminal 100 according to a second embodiment of this disclosure is illustrated. In the second embodiment, a terminal body 110 includes only one bending wing 114 formed on one of the two lateral edges 113. In the second embodiment, the terminal body 110 is also a plate-shaped member, and the bending wing 114 is substantially perpendicular to the terminal body 110. The bending wing 114 is provided with a notch 115. Under this configuration, as indicated by the base 200 shown in FIG. 6, each of insertion holes 212 is required to be provided with only one guiding groove 212*e*. That is, in this disclosure, the number of the guiding grooves 212*e* matches with the number of the bending wings 114.

Figure 10:
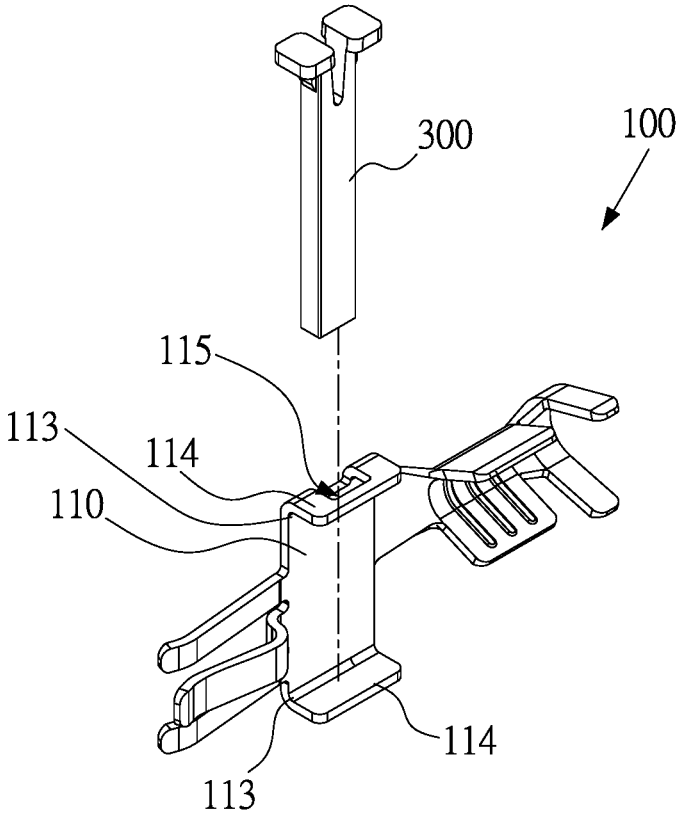
FIG. 10 illustrates a perspective view of an electrical terminal and fixing pin of an electrical connector according to a third embodiment of this disclosure.
Figure 11:
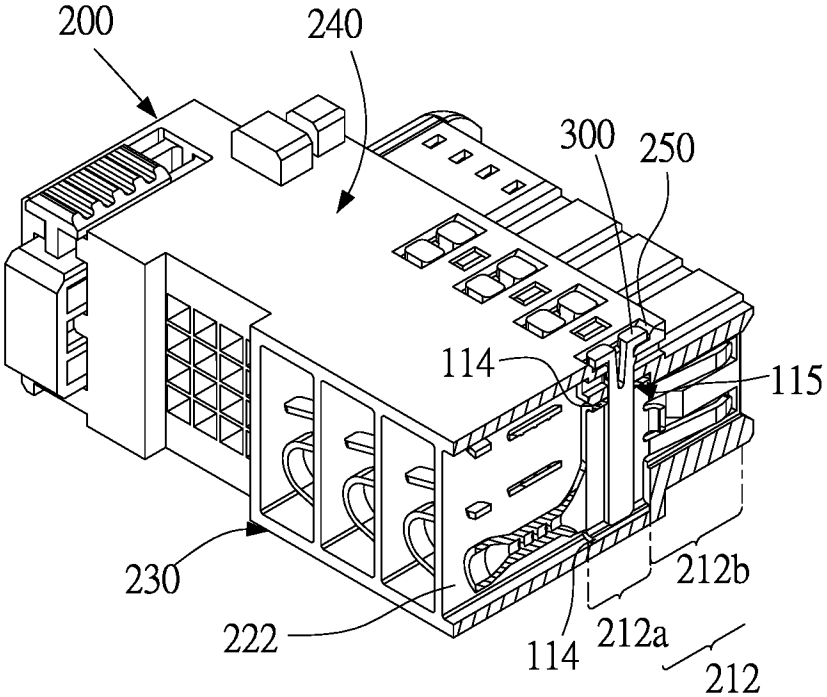
FIG. 11 illustrates a partial perspective sectional view of the electrical connector of the third embodiment.

As shown in FIG. 10 and FIG. 11, an electrical terminal 100 according to a third embodiment of this disclosure is illustrated. In the third embodiment, the terminal body 110 includes two bending wings 114 respectively formed on the two opposite lateral edges 113. In the third embodiment, the terminal body 110 is still a plate-shaped member, and the two bending wings 114 are substantially perpendicular to the terminal body 110. In this embodiment, only one of the bending wings 114 is provided with the notch 115. Therefore, as shown in FIG. 10, the length of the fixing pin 300 should be shortened to avoid interference by the bending wings 114 without the notch 115. Furthermore, the position of the bending wings 114 with the notch 115 has to be configured to correspond to the position of the fixing pin 300. Hence, after the fixing pin 300 is inserted into the pin hole 250, the fixing pin 300 could pass through the notch 115 directly.

Figure 12:
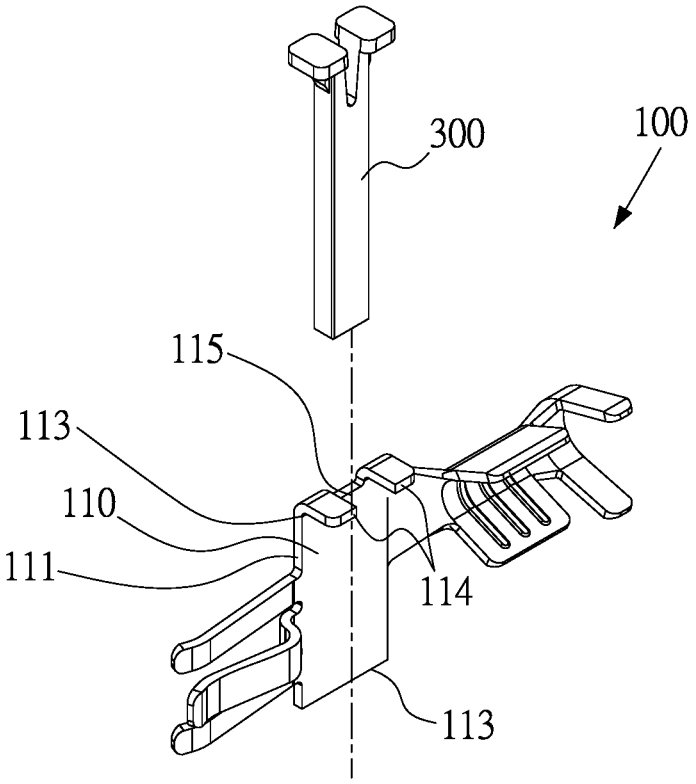
FIG. 12 illustrates a perspective view of an electrical terminal according to a fourth embodiment of this disclosure.
Figure 13:
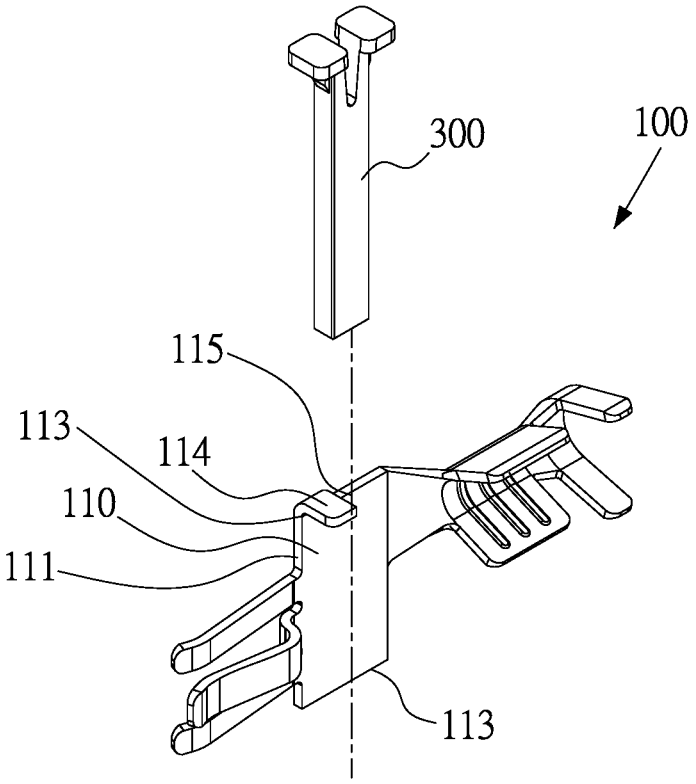
FIG. 13 illustrates a perspective view of another electrical terminal according to the fourth embodiment.

As shown in FIG. 12 and FIG. 13, an electrical terminal 100 according to a fourth embodiment of this disclosure is illustrated. In the fourth embodiment, the notch 115 is not a closed opening, but is a recessed structure formed on the edge of the bending wing 114. It is understood that, in this embodiment, the configuration of the notch 115 can be varied as long as the fixing pin 300 can pass through the notch and located in a position as close to the terminal body 110 as possible.

As shown in FIG. 12, the recessed structure may be formed on the middle portion of the bending wing 114, so that the portion corresponding to the front end 111 and a portion corresponding to the front end 112 of the notch 115 are closed, while the portion of the notch 115 in the normal direction of the terminal body 110 is opened. Hence, under this configuration, the fixing pin 300 passing through the notch 115 can still be blocked by the bending wing 114, so that the electrical terminal 100 would not move toward the rear surface 220 of the base 200.

As shown in FIG. 13, therefore the notch 115 may be a recessed structure formed on the edge of the bending wing 114. As shown in FIG. 13, the side of the notch 115 correspond to the rear end 112 may also be opened, and only the side of the notch 115 corresponding to the front end 111 is closed. The fixing pin 300 passing through the notch 115 could still be blocked by the bending wing 114 when the electrical terminal 100 is move toward the rear surface 220 of the base 200.

The notch 115 is mainly is adapted to the fixing pin 300 to block the bending wing 114 after passing through the notch 226, so that the electrical terminal 100 would not move toward to the rear surface 200 of the base 200. It is understood that, in the disclosure, the configuration of the notch 115 is not limited. That is, the notch 115 may be the opening hole as shown in FIG. 1, the recessed structure as shown in FIG. 12, or the recessed structure as shown in FIG. 13. It is understood that, the configuration of the notch 115 can be varied as long as the fixing pin 300 can pass through the notch 115 and the side of the notch 115 corresponding to the rear end 111 is closed, so that the fixing pin 300 can be adapted to block bending wing 114.

In one or more embodiments of this disclosure, the bending wing 114 formed on the edges of the electrical terminal 100 can assist the position orientation of the electrical terminal 100 when the electrical terminal 100 is installed into the base 200 of the electrical connector 1. The bending wing 114 is further provided with the notch 115, so that the fixing pin 300 can be inserted into the notch 115 of the bending wing 114. Moreover, because the notch 115 is located at the bending wing 114, the pin hole 250 for being inserted by the fixing pin 300 is configured on the top surface 230 or the bottom surface 240 of the base 200. Therefore, unnecessary holes are not formed on the front surface 210 of the base 200 so as to prevent the wrong insertion of external terminals 500.

What is claimed is:

1. An electrical connector, comprising:

an electrical terminal comprising:

a terminal body comprising a front end, a rear end, and two lateral edges opposite to each other, wherein the rear end and the front end are opposite to each other, and the two lateral edges are connected to the front end and the rear end; the terminal body further includes at least one bending wing formed on one of the two lateral edges, the at least one bending wing is provided with a notch, and one side of the notch corresponding to the front end is closed; and a mounting portion, extended from the rear end, wherein the mounting portion is provided with a fixing member; and a base, comprising a front surface, a rear surface, a top surface, and a bottom surface, wherein the front surface and the rear surface are opposite to each other; the top surface and the bottom surface are opposite to each other and connected to the front surface and the rear surface, at least one installation trough is formed on the rear surface for receiving the mounting portion of the electrical terminal; the at least one installation trough communicates with the front surface through at least one insertion hole, and the at least one insertion hole includes a fixing section and an open section, the fixing section is connected to the at least one installation trough and the open section communicates with the front surface;

wherein the fixing section includes a first wall surface and a second wall surface opposite to each other, the first wall surface is provided with at least one guiding groove for being embedded with an edge of the at least one bending wing, so that the terminal body abuts against the second wall surface.

2. The electrical connector as claimed in claim 1, wherein the electrical terminal further includes at least one contact portion extended from the front end and the contact portion is inserted into the open section.

3. The electrical connector as claimed in claim 1, wherein the first wall surface and the second wall surface are arranged in parallel to an altitude direction directed from the bottom surface to the top surface.

4. The electrical connector as claimed in claim 3, wherein the at least one installation trough communicates with the front surface through two of the insertion holes, the second wall surfaces of the two insertion holes are away from each other, and two of the electrical terminals are received in the at least one installation trough.

5. The electrical connector as claimed in claim 4, wherein the two insertion holes in the altitude direction are arranged in misalignment and the two insertion holes are located at different heights in the altitude direction.

6. The electrical connector as claimed in claim 1, wherein the base further includes a pin hole formed on the top surface or the bottom surface of the base and communicating with the fixing section; a position of the pin hole communicating with the fixing section corresponds to a position of the notch.

7. The electrical connector as claimed in claim 6, further comprising at least one fixing pin for being inserted into the pin hole to pass through the notch.

8. The electrical connector as claimed in claim 1, wherein the base further comprises a plurality of the insertion holes and a plurality of the pin holes, each of the pin holes is on the top surface or the bottom surface, and communicates with the fixing section of one of the insertion holes, and the insertion holes are arranged alternately on the top surface and the bottom surface.

9. The electrical connector as claimed in claim 1, wherein the fixing section has a stepped segment with respect to the open section.

* * * * *